US009574150B2

(12) United States Patent
Bennett et al.

(10) Patent No.: US 9,574,150 B2
(45) **Date of Patent: *Feb. 21, 2017**

(54) CONDUCTIVITY-IMPROVING ADDITIVES FOR FUEL

(71) Applicant: Afton Chemical Corporation, Richmond, VA (US)

(72) Inventors: Joshua J. Bennett, Richmond, VA (US); John Donner, Richmond, VA (US); Duncan Richardson, Reading (GB)

(73) Assignee: Afton Chemical Corporation, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/744,663

(22) Filed: Jan. 18, 2013

(65) Prior Publication Data

US 2013/0133244 A1 May 30, 2013

Related U.S. Application Data

(63) Continuation of application No. 12/266,395, filed on Nov. 6, 2008, now abandoned, which is a continuation-in-part of application No. 12/264,801, filed on Nov. 4, 2008, now abandoned.

(51) Int. Cl.

| | |
|---|---|
| ***C10L 1/22*** | (2006.01) |
| ***C10L 1/232*** | (2006.01) |
| ***C10L 1/14*** | (2006.01) |
| ***C10L 1/238*** | (2006.01) |
| ***C10L 1/2383*** | (2006.01) |
| ***C10L 10/18*** | (2006.01) |
| *C10L 1/224* | (2006.01) |

(52) U.S. Cl.

CPC ..... *C10L 1/232* (2013.01); *C10L 1/143* (2013.01); *C10L 1/22* (2013.01); *C10L 1/238* (2013.01); *C10L 1/2383* (2013.01); *C10L 10/18* (2013.01); *C10L 1/224* (2013.01)

(58) Field of Classification Search

CPC ..... C10L 10/18; C10L 1/238; C10L 1/2383; C10L 1/143; C10L 1/22; C10L 1/224; C10L 1/232

USPC ... 44/343, 347, 403, 415, 416; 508/187, 293

See application file for complete search history.

(56) References Cited

U.S. PATENT DOCUMENTS

| | | | | |
|---|---|---|---|---|
| 3,166,508 | A | 1/1965 | Fields | |
| 4,152,499 | A | 5/1979 | Boerzel et al. | |
| 4,234,435 | A | 11/1980 | Meinhardt et al. | |
| 4,256,595 | A | 3/1981 | Sung et al. | |
| 4,257,779 | A | 3/1981 | Sung et al. | |
| 4,482,356 | A | 11/1984 | Hanlon | |
| 4,963,278 | A | 10/1990 | Blain et al. | |
| 4,994,197 | A | 2/1991 | Blain et al. | |
| 5,080,815 | A | 1/1992 | Fenoglio et al. | |
| 5,294,234 | A * | 3/1994 | Emert et al. | 44/412 |
| 5,362,411 | A | 11/1994 | Bergstra et al. | |
| 5,492,638 | A | 2/1996 | Wallace | |
| 5,496,480 | A * | 3/1996 | Rollin | C07C 55/02 508/293 |
| 5,752,989 | A | 5/1998 | Henly et al. | |
| 5,997,593 | A * | 12/1999 | McDonnell | C10L 1/221 44/421 |
| 6,548,458 | B2 | 4/2003 | Loper | |
| 6,548,459 | B2 | 4/2003 | Mondal et al. | |
| 6,733,550 | B1 | 5/2004 | Grundy et al. | |
| 7,112,230 | B2 * | 9/2006 | Malfer et al. | 44/415 |
| 2002/0055440 | A1 * | 5/2002 | Balasubramaniam | 508/187 |
| 2003/0131527 | A1 | 7/2003 | Colucci et al. | |
| 2004/0118033 | A1 * | 6/2004 | Wilkes | C10L 1/14 44/385 |

(Continued)

FOREIGN PATENT DOCUMENTS

| | | | |
|---|---|---|---|
| EP | 0310364 | | 4/1989 |
| EP | 0310365 | * | 4/1989 |

(Continued)

OTHER PUBLICATIONS

Search Report of Corresponding Belgian Patent Application No. 2009/0681 dated Sep. 29, 2011.

(Continued)

*Primary Examiner* — Latosha Hines

(74) *Attorney, Agent, or Firm* — Luedeka Neely Group, P.C.

(57) ABSTRACT

A fuel additive composition, fuel comprising said additive, and methods of use thereof are provided. The fuel additive composition comprises a synergistic combination of a hydrocarbyl-substituted succinimide dispersant and a compound of the following formula:

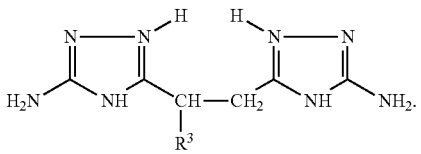

and tautomers and enantiomers thereof, wherein $R^3$ is a hydrocarbyl group having a number average molecular weight ranging from about 100 to about 5000, and wherein the weight ratio of (a) to (b) ranges from about 5:1 to about 1:5. The fuel additive composition is present in fuel in an amount sufficient to improve the conductivity properties of the fuel.

9 Claims, No Drawings

(56) References Cited

U.S. PATENT DOCUMENTS

| | | | | |
|---|---|---|---|---|
| 2004/0180797 | A1* | 9/2004 | Huffer | C08F 8/00 508/232 |
| 2005/0183325 | A1 | 8/2005 | Sutkowski | |
| 2008/0127550 | A1 | 6/2008 | Li et al. | |
| 2008/0256849 | A1* | 10/2008 | Kulinowski | C10L 10/14 44/348 |
| 2008/0263939 | A1* | 10/2008 | Baxter | C10L 1/143 44/347 |
| 2009/0000185 | A1* | 1/2009 | Aulich et al. | 44/308 |
| 2009/0082235 | A1 | 3/2009 | Hilker | |
| 2009/0282731 | A1 | 11/2009 | Malfer et al. | |
| 2010/0107479 | A1 | 5/2010 | Richardson | |

FOREIGN PATENT DOCUMENTS

| | | | |
|---|---|---|---|
| EP | 0310365 | A1 * | 4/1989 |
| EP | 0663436 | | 7/1995 |
| EP | 0921136 | | 6/1999 |
| EP | 968259 | | 1/2000 |
| EP | 2103672 | A1 | 9/2009 |
| GB | 2280907 | | 2/1995 |
| GB | 2465057 | A | 10/2009 |
| GB | 2465057 | A1 | 12/2010 |
| WO | 9504117 | A1 | 2/1995 |
| WO | WO02/06428 | * | 1/2002 |
| WO | 2006136591 | | 12/2006 |

OTHER PUBLICATIONS

Singapore Search and Examination Report, Singapore Application No. 0906895-8, Singapore Patent Office, Mar. 11, 2010.

Great Britain Search Report, Great Britain application # GB0918576.0, Great Britain patent office, Feb. 19, 2010.

Great Britain Search Report, Great Britain application # GB0918576.0, Great Britain patent office, May 3, 2011.

* cited by examiner

CONDUCTIVITY-IMPROVING ADDITIVES FOR FUEL

RELATED APPLICATIONS

This application is a continuation of and claims priority under 35 U.S.C. §120 to U.S. Ser. No. 12/266,395, filed Nov. 6, 2008, which is a continuation-in-part of and claims priority to U.S. Ser. No. 12/264,801, filed Nov. 4, 2008, the disclosures of which are incorporated herein in their entirety by reference.

FIELD OF THE INVENTION

This disclosure relates generally to fuel additive compositions. More specifically, the present disclosure is directed to fuel additive compositions that are effective to enhance the conductivity properties of fuel, and methods of use thereof.

BACKGROUND OF THE INVENTION

It is widely known that electrostatic charges can be frictionally transferred between two dissimilar, nonconductive materials. When this occurs, the electrostatic charge thus created appears at the surfaces of the contacting materials. The magnitude of the generated charge is dependent upon the nature of and, more particularly, the respective conductivity of each material. For example, electrostatic charging occurs when water settles through a hydrocarbon solution. This situation greatly interests the petroleum industry, for when such charges are built up in or around flammable liquids, their eventual discharge can lead to incendiary sparking, and perhaps to a serious fire or explosion.

While incendiary sparking is a problem in the petroleum industry, the potential for fire and explosion is probably at its greatest during product handling, transfer and transportation. For example, static charges are known to accumulate in solvents and fuels when they flow through piping, especially when these liquids flow through high surface area or "fine" filters and other process controls, such as is common during tank truck filling. Countermeasures designed to prevent accumulation of electrostatic charges on a container being filled and to prevent sparks by conducting the container to ground can be employed, such as container grounding (i.e. "earthing") and bonding. But it has been recognized that these measures are inadequate to deal successfully with all of the electrostatic hazards presented by hydrocarbon fuels.

Alone, grounding and bonding are not sufficient to prevent electrostatic build-up in low conductivity, volatile organic liquids such as distillate fuels like diesel, gasoline, jet fuel, turbine fuels, and kerosene. Similarly, grounding and bonding do not prevent static charge accumulation in relatively clean (i.e., contaminant free) light hydrocarbon oils such as organic solvents and cleaning fluids. This is because the conductivity of these organics is so low that a static charge moves very slowly through these liquids and can take a considerable time to reach the surface of a grounded, conductive container. Until this occurs, a high surface-voltage potential can be achieved, which can create an incendiary spark, thereby causing ignition or explosion.

One can directly attack the source of the increased hazard presented by these low conductivity organic liquids by increasing the conductivity of the liquid with additives. The increased conductivity of the liquid will substantially reduce the time necessary for any charges that exist in the liquid to be conducted away by the grounded inside surface of the container. Various compositions are known for use as additives to increase the electrical conductivity of these liquids.

For example, in the past, halogen-containing additives introduced into fuels have played a significant role in achieving improved conductivity properties in fuels. While these halogen-containing additives are effective as conductivity agents, in certain situations, some halogen-containing hydrocarbon compounds have been linked to human and animal health risks, as well as environmental degradation. Legislative enactments, including the 1990 amendment to "The Clean Air Act" in the United States, signal a trend away from the continued permissible use in media of halogen-containing compounds. Even where the use of halogen-containing additives is still permitted, stringent regulations often govern the use, storage and, in particular, the disposal of and/or treatment of waste streams containing these compositions. Accordingly, a need exists to find fuel additives that improve the conductivity of fuel without posing negative risks to humans, animals, and the environment.

SUMMARY OF DISCLOSURE

In accordance with the disclosure, there is provided a fuel additive composition comprising a synergistic combination of (a) a hydrocarbyl-substituted succinimide dispersant, and (b) a compound of formula (III):

(III)

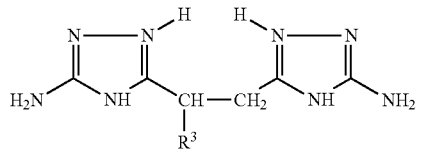

and tautomers and enantiomers thereof, wherein $R^3$ is a hydrocarbyl group having a number average molecular weight ranging from about 100 to about 5000, and wherein the weight ratio of (a) to (b) ranges from about 1:5 to about 5:1.

Another aspect of the disclosure provides a fuel composition comprising a major amount of fuel; and a minor amount of a synergistic additive composition comprising (a) a hydrocarbyl-substituted succinimide dispersant, and (b) a compound of formula (III):

(III)

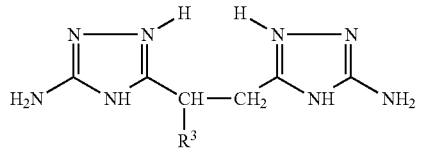

and tautomers and enantiomers thereof, wherein $R^3$ is a hydrocarbyl group having a number average molecular weight ranging from about 100 to about 5000, and wherein the weight ratio of (a) to (b) ranges from about 1:5 to about 5:1.

A further aspect of the disclosure provides a method of improving the conductivity of a fuel comprising combining a major amount of fuel, and a minor amount of a synergistic additive composition comprising (a) a hydrocarbyl-substituted succinimide dispersant, and (b) a compound of formula (III):

(III)

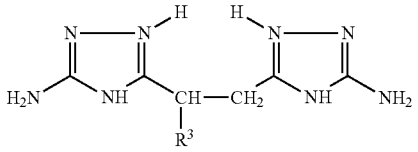

and tautomers and enantiomers thereof, wherein $R^3$ is a hydrocarbyl group having a number average molecular weight ranging from about 100 to about 5000, and wherein the weight ratio of (a) to (b) ranges from about 1:5 to about 5:1.

Additional embodiments and advantages of the disclosure will be set forth in part in the detailed description which follows, and/or can be learned by practice of the disclosure. It is to be understood that both the foregoing general description and the following detailed description are exemplary and explanatory only and are not restrictive of the disclosure, as claimed.

DETAILED DESCRIPTION OF DISCLOSURE

The present disclosure relates to a fuel additive composition comprising (a) a hydrocarbyl-substituted succinimide dispersant, and (b) a compound of formula (III):

(III)

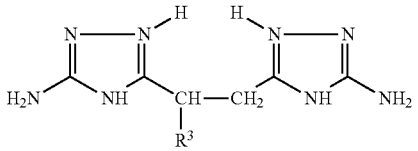

and tautomers and enantiomers thereof, wherein $R^3$ is a hydrocarbyl group having a number average molecular weight ranging from about 100 to about 5000, and wherein the weight ratio of (a) to (b) ranges from about 1:5 to about 5:1.

As used herein, "middle distillate fuel" is understood to mean one or more fuels selected from the group consisting of diesel fuel, biodiesel, biodiesel-derived fuel, synthetic diesel, jet fuels, kerosene, diesel fuel treated with oxygenates for particulate control, mixtures thereof, and other products meeting the definitions of ASTM D975. As used herein, "biodiesel" is understood to mean diesel fuel comprising fuel derived from biological sources. In an aspect, the middle distillate fuel can contain up to 30%, for example from about 0.5% to about 30%, such as from about 10% to about 20%, fuel derived from biological sources.

The middle distillate fuel can be derived from biological sources such as oleaginous seeds, for example rapeseed, sunflower, soybean seeds, and the like. The seeds can be submitted to grinding and/or solvent extraction treatments (e.g., with n-hexane) in order to extract the oil, which comprises triglycerides of saturated and unsaturated (mono- and poly-unsaturated, in mixture with each other, in proportions depending on the selected oleaginous seed) $C_{16}$-$C_{22}$ fatty acids. The oil can be submitted to a filtration and refining process, in order to remove any possible free fats and phospholipids present, and can be submitted to a transesterification reaction with methanol in order to prepare the methyl esters of the fatty acids (fatty acid methyl esters, also known as "FAME" and commonly referred to as biodiesel.)

As used herein, the term "hydrocarbyl group" or "hydrocarbyl" is used in its ordinary sense, which is well-known to those skilled in the art. Specifically, it refers to a group having a carbon atom directly attached to the remainder of a molecule and having a predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein, the term "major amount" is understood to mean an amount greater than or equal to 50 wt. %, for example from about 80 to about 98 wt % relative to the total weight of the composition. Moreover, as used herein, the term "minor amount" is understood to mean an amount less than 50 wt. % relative to the total weight of the composition.

The compositions of the present disclosure can comprise a compound of formula (III) comprising the reaction product of an amine compound or salt thereof and a hydrocarbyl carbonyl compound. Suitable amine compounds for use herein can be amine compounds of salts thereof of formula (I):

(I)

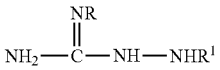

wherein R is selected from the group consisting of a hydrogen and a hydrocarbyl group containing from about 1 to about 15 carbon atoms, and $R^1$ is selected from the group consisting of hydrogen and a hydrocarbyl group containing from about 1 to about 20 carbon atoms. Such amine compounds can be chosen from guanidines and aminoguanidines or salts thereof, wherein R and $R^1$ are as defined above. Accordingly, the amine compound can be chosen from the inorganic salts of aminoguanidienes and guanidines, such as the halide, carbonate, bicarbonate, nitrate, phosphate, and orthophosphate salts of aminoguanidines and guanidines. As used herein, the term "guanidines" is understood to refer to guanidine and guanidine derivatives, such as aminoguanidine. In an embodiment, the amine compound for the preparation of the additive can be aminoguanidine bicarbonate. Aminoguanidine bicarbonates are readily obtainable from commercial sources, or can be prepared in a well-known manner.

Suitable hydrocarbyl carbonyl compounds for use herein can be any suitable compound having a hydrocarbyl moiety and a carbonyl moiety, and that is capable of bonding with the amine compound to form the additives of the disclosure. Non-limiting examples of suitable hydrocarbyl carbonyl compounds include, but are not limited to, hydrocarbyl substituted dicarboxylic acids or anhydrides, such as hydrocarbyl-substituted succinic anhydrides, hydrocarbyl-substituted succinic acids, and esters of hydrocarbyl-substituted succinic acids.

In some aspects, the hydrocarbyl carbonyl compound can be a hydrocarbyl-substituted succinic anhydride of formula (II):

(II)

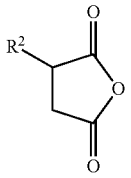

wherein $R^2$ is a hydrocarbyl group having a number average molecular weight ranging from about 100 to about 5,000, such as from about 200 to about 3,000, as measured by gel permeation chromatograph (GPC). Unless indicated otherwise, molecular weights in the present disclosure are number average molecular weights.

In some aspects, the $R^2$ group of the hydrocarbyl carbonyl compound can comprise one or more polymer units chosen from linear or branched alkenyl units. For example, the alkenyl units can comprise from about 2 to about 10 carbon atoms. In embodiments, the $R^2$ group can comprise one or more linear or branched polymer units chosen from ethylene radicals, propylene radicals, butylene radicals, pentene radicals, hexene radicals, octene radicals, and decene radicals. In some aspects, the $R^2$ group can be in the form of, for example, a homopolymer, copolymer, or terpolymer. In an embodiment, the $R^2$ group can be isobutylene. Accordingly, in an embodiment, the $R^2$ group can be a homopolymer of polyisobutylene comprising from about 10 to about 60 isobutylene groups, such as from about 20 to about 30 isobutylene groups. The compounds used to form the $R^2$ hydrocarbyl groups can be formed by any suitable methods, such as by conventional catalytic oligomerization of alkenes. A non-limiting example of $R^2$ can be a polyalkenyl radical, such as a polyisobutylene radical, having a number average molecular weight of from about 100 to about 5,000, such as from about 200 to about 3,000, as measured by GPC.

In some aspects, the $R^2$ group of the hydrocarbyl carbonyl compound can be formed from highly reactive polyisobutylenes (HR-PIB) having relatively high terminal vinylidene content. As used herein, "terminal vinylidene content" is understood to mean terminal olefinic double bond content. In an embodiment, the $R^2$ group can be formed from HR-PIB having at least about 60%, such as about 70% to about 90% and above, terminal vinylidene content. There is a general trend in the industry to convert to HR-PIB, and well known HR-PIBs are disclosed, for example, in U.S. Pat. No. 4,152,499, the disclosure of which is herein incorporated by reference in its entirety.

The hydrocarbyl carbonyl compounds can be made using any suitable method. Methods for forming hydrocarbyl carbonyl compounds are well known in the art. One example of a known method for forming a hydrocarbyl carbonyl compound comprises blending a polyolefin and an anhydride, such as maleic anhydride. The polyolefin and anhydride reactants can be heated to temperatures of, for example, about 150° C. to about 250° C., optionally, with the use of a catalyst, such as chlorine or peroxide. Another exemplary method of making the hydrocarbyl carbonyl compounds is described in U.S. Pat. No. 4,234,435, which is incorporated herein by reference in its entirety.

In some aspects, approximately one mole of maleic anhydride can be reacted per mole of polyolefin, such that the resulting hydrocarbyl-substituted succinic anhydride has about 0.8 to about 1 succinic anhydride group per hydrocarbyl group. In other aspects, the weight ratio of succinic anhydride groups to hydrocarbyl group can range from about 0.5 to about 3.5, such as from about 1 to about 1.1.

Examples of hydrocarbyl carbonyl compounds useful herein include, but are not limited to, such compounds as dodecenylsuccinic anhydrides, $C_{16-18}$ alkenyl succinic anhydride, and polyisobutenyl succinic anhydride (PIBSA). In some embodiments, the PIBSA can have a polyisobutylene substituent with a terminal vinylidene content ranging from about 4% to at least about 60%, such as about 70% to about 90% and above. In some embodiments, the ratio of the number of carbonyl groups to the number of hydrocarbyl moieties in the hydrocarbyl carbonyl compound can range from about 1:1 to about 6:1.

The hydrocarbyl carbonyl and amine compounds described above can be mixed together under any suitable conditions to provide the desired reaction products of the present disclosure. In an aspect, the reactant compounds can be mixed together in a mole ratio of hydrocarbyl carbonyl compound to amine compound ranging from about 2:1 to about 1:2.5. For example, the mole ratio of the reactants can range from about 1:1 to about 1:2.2. Suitable reaction temperatures can range from about 155° C. to about 200° C. at atmospheric pressure. For example, reaction temperatures can range from about 160° C. to about 190° C. Any suitable reaction pressures can be used, such as subatmospheric pressures or superatmospheric pressures. However, the range of temperatures can be different from those listed where the reaction is carried out at other than atmospheric pressure. The reaction can be carried out for a period of time within the range of about 1 hour to about 8 hours, preferably, within the range of about 2 hours to about 6 hours.

Without desiring to be bound by theoretical considerations, it is believed that the reaction product of the amine and hydrocarbyl carbonyl compound is an aminotriazole compound, such as a bis-aminotriazole compound of formula (III):

(III)

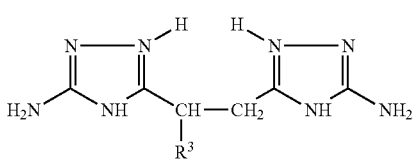

including tautomers and enantiomers thereof, wherein $R^3$ has a number average molecular weight ranging from about 100 to about 5000, and comprises from about 40 to about 80 carbon atoms. In an embodiment, $R^3$ is a polyisobutenyl substituent, for example a polyisobutenyl substituent formed from HR-PIB having at least about 60%, such as about 70% to about 90% and above, terminal vinylidene content. The reaction product can contain at least one aminotriazole group. The five-membered ring of the triazole is considered to be aromatic. The aminotriazoles can be fairly stable to oxidizing agents and can be extremely resistant to hydrolysis. It is believed, although it is not certain, that the reaction product is polyalkenyl bis-3-amino-1,2,4-triazole. Such a product contains a relatively high nitrogen content, within the range of about 1.8 wt % to about 2.9 wt % nitrogen.

In some aspects of the present disclosure, the disclosed fuel compositions can comprise a dispersant, such as an amine-containing dispersant. Suitable amine-containing dispersants can comprise hydrocarbyl-substituted succinimide dispersants. The hydrocarbyl substituent of the dispersant can have a number average molecular weight ranging from about 100 to about 5000, such as about 500 to about 5000, as determined by GPC.

As used herein the term "succinimide" is meant to encompass the completed reaction product from reaction between an amine and a hydrocarbyl-substituted succinic acid or anhydride (or like succinic acylating agent), and is intended to encompass compounds wherein the product may have amide, and/or salt linkages in addition to the imide linkage of the type that results from the reaction of or contact with an amine and an anhydride moiety.

Suitable hydrocarbyl-substituted succinic anhydrides can be formed by first reacting an olefinically unsaturated hydrocarbon of a desired molecular weight with maleic anhydride. Reaction temperatures of about 100° C. to about 250° C. can be used. With higher boiling olefinically-unsaturated hydrocarbons, good results are obtained at about 200° C. to about 250° C. This reaction can be promoted by the addition of chlorine.

Typical olefins include, but are not limited to, cracked wax olefins, linear alpha olefins, branched chain alpha olefins, polymers and copolymers of lower olefins. The olefins can be chosen from ethylene, propylene, butylene, such as isobutylene, 1-octane, 1-hexene, 1-decene and the like. Useful polymers and/or copolymers include, but are not limited to, polypropylene, polybutenes, polyisobutene, ethylene-propylene copolymers, ethylene-isobutylene copolymers, propylene-isobutylene copolymers, ethylene-1-decene copolymers and the like.

In an aspect, the hydrocarbyl substituents of the hydrocarbyl-substituted succinic anhydrides can be derived from butene polymers, for example polymers of isobutylene. Suitable polyisobutenes for use herein include those formed from HR-PIB having at least about 60%, such as about 70% to about 90% and above, terminal vinylidene content. Suitable polyisobutenes can include those prepared using $BF_3$ catalysts. The average number molecular weight of the hydrocarbyl substituent can vary over a wide range, for example from about 100 to about 5000, such as from about 500 to about 5000, as determined by GPC.

Carboxylic reactants other than maleic anhydride can be employed such as maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and lower aliphatic esters.

The mole ratio of maleic anhydride to olefin can vary widely. It can vary from about 5:1 to about 1:5, for example from about 3:1 to about 1:3, and as a further example, the maleic anhydride can be used in stoichiometric excess to force the reaction to completion. The unreacted maleic anhydride can be removed by vacuum distillation.

Any of numerous polyamines can be utilized in preparing the hydrocarbyl-substituted succinimide dispersant. Non-limiting exemplary polyamines can include aminoguanidine bicarbonate (AGBC), diethylene triamine (DETA), triethylene tetramine (TETA), tetraethylene pentamine (TEPA), pentaethylene hexamine (PEHA) and heavy polyamines. A heavy polyamine can comprise a mixture of polyalkylene-polyamines comprising small amounts of lower polyamine oligomers such as TEPA and PEHA, but primarily oligomers with 7 or more nitrogens, 2 or more primary amines per molecule, and more extensive branching than conventional polyamine mixtures. Additional non-limiting polyamines which can be utilized in preparing the hydrocarbyl-substituted succinimide dispersant are disclosed in U.S. Pat. No. 6,548,458, the disclosure of which is incorporated herein by reference in its entirety. In an embodiment, the polyamine can comprise tetraethylene pentamine (TEPA).

In an embodiment, the dispersant can include compounds of formula (IV):

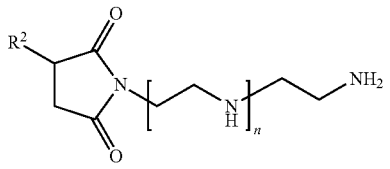

wherein n represents 0 or an integer of from 1 to 5, and $R^2$ is a hydrocarbyl substituent as defined above. In an embodiment, n is 3 and $R^2$ is a polyisobutenyl substituent, such as that derived from polyisobutylenes having at least about 60%, such as about 70% to about 90% and above, terminal vinylidene content. Compounds of formula (IV) can be the reaction product of a hydrocarbyl-substituted succinic anhydride, such as a polyisobutenyl succinic anhydride (PIBSA), and a polyamine, for example tetraethylene pentamine (TEPA).

The presently disclosed dispersants can used in the range of about 1 wt % to about 70 wt. %, such as about 5 wt. % to about 50 wt. %, for example about 10 wt. % to about 30 wt. %, relative to the total weight of the additive composition. In an aspect, the disclosed aminotriazole compound and dispersant can be present in a fuel composition at a weight ratio ranging from about 1:5 to about 5:1, such as from about 2:1 to about 1:1.

In an aspect, the presently disclosed aminotriazoles can used in the range of about 1 wt. % to about 70 wt. %, such as about 5 wt. % to about 50 wt. %, for example about 10 wt. % to about 30 wt. %, relative to the total weight of the additive composition.

In other aspects of the present disclosure, the disclosed compositions can comprise a fuel soluble carrier. Such carriers can be of various types, such as liquids or solids, e.g., waxes. Examples of liquid carriers include, but are not limited to, mineral oil and oxygenates, such as liquid polyalkoxylated ethers (also known as polyalkylene glycols or polyalkylene ethers), liquid polyalkoxylated phenols, liquid polyalkoxylated esters, liquid polyalkoxylated amines, and mixtures thereof. Examples of the oxygenate carriers can be found in U.S. Pat. No. 5,752,989, the description of which carriers is herein incorporated by reference in its entirety. Additional examples of oxygenate carriers include alkyl-substituted aryl polyalkoxylates described in U.S. Patent Publication No. 2003/0131527, published Jul. 17, 2003 to Colucci et. al., the description of which is herein incorporated by reference in its entirety.

In other aspects, compositions of the present application may not contain a carrier. For example, some compositions of the present application may not contain mineral oil or oxygenates, such as those oxygenates described above.

One or more additional optional additives can be present in the compositions disclosed herein. For example, the compositions can contain antifoam agents, dispersants, detergents, antioxidants, thermal stabilizers, carrier fluids, metal deactivators, dyes, markers, corrosion inhibitors, biocides, antistatic additives, drag reducing agents, friction modifiers, demulsifiers, emulsifiers, dehazers, anti-icing additives, antiknock additives, surfactants, cetane improvers, corrosion inhibitors, cold flow improvers, pour point depressants, solvents, demulsifiers, lubricity additives, extreme pressure agents, viscosity index improvers, seal swell agents, amine stabilizers, combustion improvers, dispersants, conductivity improvers, metal deactivators, marker dyes, organic nitrate ignition accelerators, manganese tricarbonyl compounds, and mixtures thereof. In some aspects, the fuel additive compositions described herein can contain about 10 wt. % or less, or in other aspects, about 5 wt. % or less, based on the total weight of the additive or fuel composition, of one or more of the above additives. Similarly, the fuel compositions can contain suitable amounts of fuel blending components such as methanol, ethanol, dialkyl ethers, and the like.

When formulating the presently disclosed compositions, the disclosed additives can be employed in amounts sufficient to improve the conductivity properties of a fuel, such as middle distillate fuel, for example diesel fuel. In some aspects, the fuels can contain a major amount of a fuel and a minor amount of the above-described fuel additive composition. In an aspect, fuels of the present disclosure can comprise, on an active ingredient basis, an aminotriazole compound as described herein in an amount ranging from about 1 ppm to about 200 ppm, such as from about 5 ppm to about 50 ppm. In another aspect, the presently disclosed fuel compositions can comprise, on an active ingredient basis, a dispersant as described herein in an amount ranging from about 5 to about 500 ppm, such as from about 20 ppm to about 200 ppm.

In aspects where a carrier is employed, the fuel compositions can contain, on an active ingredients basis, an amount of the carrier ranging from about 1 mg to about 100 mg of carrier per kg of fuel, such as about 5 mg to about 50 mg of carrier per kg of fuel. The active ingredient basis excludes the weight of (i) unreacted components associated with and remaining in the disclosed additives as produced and used, and (ii) solvent(s), if any, used in the manufacture of the disclosed additives either during or after its formation but before addition of a carrier, if a carrier is employed.

The fuel additives of the present disclosure can be blended into a base fuel individually or in various subcombinations. In some embodiments, the additive components of the present disclosure can be blended into a fuel concurrently using an additive concentrate, as this takes advantage of the mutual compatibility and convenience afforded by the combination of ingredients when in the form of an additive concentrate. Also, use of a concentrate can reduce blending time and lessen the possibility of blending errors.

The fuel compositions of the present disclosure can be applicable to the operation of both stationary diesel engines (e.g., engines used in electrical power generation installations, in pumping stations, etc.) and ambulatory diesel engines (e.g., engines used as prime movers in automobiles, trucks, road-grading equipment, military vehicles, etc.).

In an aspect, there is provided a method of improving the conductivity of a fuel comprising: providing a major amount of fuel, and a minor amount of an additive composition comprising: (a) a hydrocarbyl-substituted succinimide dispersant, and (b) a compound of formula (III):

(III)

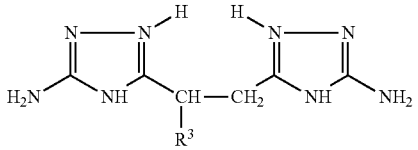

and tautomers and enantiomers thereof, wherein $R^3$ is a hydrocarbyl group having a number average molecular weight ranging from about 100 to about 5000, and wherein the ratio of (a) to (b) ranges from about 1:2 to about 2:1. In an aspect, the fuel can comprise a middle distillate fuel, such as a diesel fuel.

EXAMPLES

The following examples are illustrative of exemplary embodiments of the disclosure. In these examples as well as elsewhere in this application, all parts and percentages are by weight unless otherwise indicated. It is intended that these examples are being presented for the purpose of illustration only and are not intended to limit the scope of the invention disclosed herein.

Example 1

A 950 number average molecular weight polybutenyl succinic anhydride was heated to 95° C. An oil slurry of aminoguanidine bicarbonate (AGBC) was added over a 45 minute period. The mixture was heated under vacuum to 160° C. and held at that temperature for about 6 hours, removing water and carbon dioxide. The resulting mixture was filtered. It is believed, without being limited by theory, that the resultant mixture comprises an aminotriazole as described herein.

In the following examples, various base diesel fuels were each combined with a dispersant and an aminotriazole as described in Table 1 to produce fuel formulations that were evaluated for fuel conductivity as described below. The dispersant used was a succinimide formed by the reaction of PIBSA with TEPA on a 1:1 mole ratio. The aminotriazole used was the aminotriazole mixture described above,

TABLE 1

| | Dispersant (ppmw) | Aminotriazole (ppmw) | Conductivity (pS/m) |
|---|---|---|---|
| Fuel A | 0 | 0 | 2 |
| Fuel B | 0 | 60 | 328 |
| Fuel C | 20 | 40 | 1013 |
| Fuel D | 30 | 30 | 691 |
| Fuel E | 40 | 20 | 525 |
| Fuel F | 60 | 0 | 121 |

Conductivities of the test fuels were evaluated according to ASTM 2624 using an EMCEE conductivity meter (Model 1152) having a range of from about 1 to about 2000 picosiemens $m^{-1}$ (pS/m). All conductivity values were measured within a temperature range of from about 20° C. to about 25° C. All conductivity measurements are in picosiemens $m^{-1}$ (pS/m), also known as CU or Conductivity Units.

It was observed that Fuel A (comprising none of the additives) demonstrated poor conductivity (2 pS/m). Fuel B (comprising 60 ppm of an aminotriazole) demonstrated a conductivity of 328 pS/m, and Fuel F (comprising 60 ppm of a dispersant) demonstrated a conductivity of 121 pS/m.

However, Fuels C through E (comprising a combination of the dispersant and aminotriazole) showed unexpected results for fuels that contain the additive composition, thus illustrating the synergistic effect of the aminotriazole and dispersant together. In fact, Fuel C demonstrated over 90% improvement and over 70% improvement in conductivity values over Fuels F and B, respectively. The results for Fuels C through E were considered as being unexpected because, for example, each compound used alone showed less benefit than the combination. In other words, as seen from the results, Fuels C through E (each comprising a combination of aminotriazole and dispersant) surprisingly demonstrated much higher conductivity values as compared to Fuels B and F, each comprising the aminotriazole and dispersant alone, respectively. Accordingly, it is believed that the additive composition as described herein can be effective for improving the conductivity properties of fuels.

It is noted that, as used in this specification and the appended claims, the singular forms "a," "an," and "the," include plural referents unless expressly and unequivocally limited to one referent. Thus, for example, reference to "a dispersant" includes two or more different dispersants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A synergistic fuel additive composition that provides a fuel conductivity ranging from at least about 500 pS/m to about 2000 pS/m at about 20° to about 25° C. according to ASTM 2624 in a middle distillate fuel, the synergistic fuel additive composition comprising:

a) from about 20 to about 40 ppm by weight of a hydrocarbyl-substituted succinimide having the formula

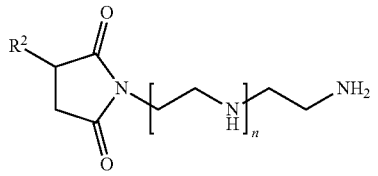

wherein n is 3, and $R^2$ is a polyisobutenyl substituent derived from polyisobutylenes having at least 60 mole % and above terminal vinylidene content; and b) from about 20 to about 40 ppm by weight of a reaction product of (i) aminoguanidine or salt thereof and (ii) a polyisobutenyl-substituted dicarboxylic acid, or polyisobutenyl-substituted anhydride, wherein the polyisobutenyl group has 60 mole % or more terminal vinylidene groups and a number average molecular weight ranging from about 100 to about 5000 as measured by gel permeation chromatography (GPC); and wherein a weight ratio of (a) to (b) ranges from about 2:1 to about 1:2.

2. The fuel additive composition of claim 1, wherein the $R^2$ has a number average molecular weight as measured by GPC of from about 100 to about 5000.

3. The fuel additive composition of claim 1, wherein component (b) is present in an amount ranging from about 1 wt. % to about 70 wt. % relative to a total weight of the additive composition.

4. A middle distillate fuel composition characterized as having a fuel conductivity ranging from at least about 500 pS/m to about 2000 pS/m at about 20° to about 25° C. according to ASTM 2624, wherein the fuel composition comprises:

a) a major amount of middle distillate fuel;

b) from about 20 to about 40 ppm by weight of a hydrocarbyl-substituted succinimide having the formula

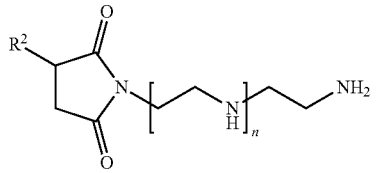

wherein n is 3, and $R^2$ is a polyisobutenyl substituent derived from polyisobutylenes having at least 60 mole % and above terminal vinylidene content; and c) from about 20 to about 40 ppm by weight of a reaction product of (i) aminoguanidine or salt thereof and (ii) a polyisobutenyl-substituted dicarboxylic acid, or polyisobutenyl-substituted anhydride, wherein the polyisobutenyl group has 60 mole % or more terminal vinylidene groups and a number average molecular weight ranging from about 100 to about 5000 as measured by gel permeation chromatography (GPC); and wherein a weight ratio of (b) to (c) ranges from about 2:1 to about 1:2.

5. The fuel composition of claim 4, wherein the $R^2$ has a number average molecular weight as measured by GPC of from about 100 to about 5000.

6. The fuel composition of claim 4, further comprising at least one additive selected from the group consisting of antifoam agents, dispersants, detergents, antioxidants, thermal stabilizers, carrier fluids, metal deactivators, dyes, markers, corrosion inhibitors, biocides, antistatic additives, drag reducing agents, friction modifiers, demulsifiers, emulsifiers, dehazers, anti-icing additives, antiknock additives, surfactants, cetane improvers, corrosion inhibitors, cold flow improvers, pour point depressants, solvents, demulsifiers, lubricity additives, extreme pressure agents, viscosity index improvers, seal swell agents, amine stabilizers, combustion improvers, dispersants, metal deactivators, marker dyes, organic nitrate ignition accelerators, manganese tricarbonyl compounds, and mixtures thereof.

7. A method of increasing the conductivity of a middle distillate fuel composition to a range of from at least about 500 pS/m to about 2000 pS/m at about 20° to about 25° C. according to ASTM 2624, the method comprising:

combining a major amount of middle distillate fuel from about 40 to about 80 ppm by weight of a synergistic fuel additive composition consisting essentially of:

a) from about 20 to about 40 ppm by weight of a hydrocarbyl-substituted succinimide having the formula

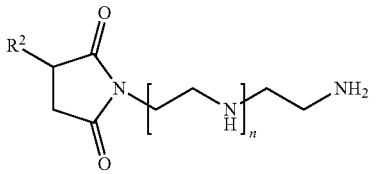

wherein n is 3, and $R^2$ is a polyisobutenyl substituent derived from polyisobutylenes having at least 60% and above terminal vinylidene content; and b) from about 20 to about 40 ppm by weight of a reaction product of (i) aminoguanidine or salt thereof and (ii) a polyisobutenyl-substituted dicarboxylic acid, or polyisobutenyl-substituted anhydride, wherein the polyisobutenyl group has 60 mole % or more terminal vinylidene groups and a number average molecular weight ranging from about 100 to about 5000 as measured by gel permeation chromatography (GPC); and wherein a weight ratio of (a) to (b) ranges from about 2:1 to about 1:2.

8. The method of claim 7, wherein the $R^2$ has a number average molecular weight as measured by GPC of from about 100 to about 5000.

9. The method of claim 7, wherein the middle distillate fuel further comprises at least one additive selected from the group consisting of antifoam agents, dispersants, detergents, antioxidants, thermal stabilizers, carrier fluids, metal deactivators, dyes, markers, corrosion inhibitors, biocides, antistatic additives, drag reducing agents, friction modifiers, demulsifiers, emulsifiers, dehazers, anti-icing additives, antiknock additives, surfactants, cetane improvers, corrosion inhibitors, cold flow improvers, pour point depressants, solvents, demulsifiers, lubricity additives, extreme pressure agents, viscosity index improvers, seal swell agents, amine stabilizers, combustion improvers, dispersants, metal deactivators, marker dyes, organic nitrate ignition accelerators, manganese tricarbonyl compounds, and mixtures thereof.

* * * * *